US005454361A

United States Patent [19]

Bronnert

[11] Patent Number: 5,454,361

[45] Date of Patent: Oct. 3, 1995

[54] SEQUENTIAL BOW

[76] Inventor: Hervé X. Bronnert, 21495 Partridge Ct., Brookfield, Wis. 53005

[21] Appl. No.: 59,892

[22] Filed: May 10, 1993

[51] Int. Cl.[6] ..... F41B 5/14

[52] U.S. Cl. ..... 124/23.1; 124/25.6

[58] Field of Search ..... 124/23.1, 25.6; 267/158, 151, 152, 164

[56] References Cited

U.S. PATENT DOCUMENTS

| | | | |
|---|---|---|---|
| 2,100,317 | 11/1937 | Hickman | 124/23.1 |
| 3,674,001 | 7/1972 | Hitt | 124/23.1 |
| 3,757,762 | 9/1973 | Cousin | 124/23.1 |
| 3,901,210 | 8/1975 | Stewart | 124/23.1 |
| 4,112,909 | 9/1978 | Caldwell . | |
| 4,122,821 | 10/1978 | Mamo | 124/23.1 |
| 4,183,345 | 1/1980 | Caldwell . | |
| 4,340,025 | 7/1982 | Caldwell . | |
| 4,350,138 | 9/1982 | Caldwell . | |
| 4,541,401 | 9/1985 | Caldwell . | |
| 4,644,929 | 2/1987 | Peck | 124/23.1 |
| 4,733,647 | 3/1988 | Mattheck | 124/23.1 |
| 4,989,577 | 2/1991 | Bixby | 124/25.6 |
| 5,231,970 | 8/1993 | Ploot et al. | 124/23.1 |

*Primary Examiner*—Anthony Knight
*Attorney, Agent, or Firm*—Foley & Lardner

[57] ABSTRACT

A sequential bow including a hand held riser having a limb pivotally mounted on each end of the riser. Each limb includes an inner section, an intermediate section and an outer section of different degrees of flexibility. A support member is mounted on each end of the risers in a position to engage the intermediate section of each of the limbs. A bowstring is attached to the ends of each of the limbs so that the outer section of the limbs will be drawn together rearwardly of the support members to form a recurve in the inner section of the limb.

8 Claims, 6 Drawing Sheets

SEQUENTIAL BOW

FIELD OF THE INVENTION

The present invention relates to a sequential bow, more particularly the invention pertains to a recurve bow in which the bow limbs are sequentially set in action in a succession of phases which change the drawing force of the string.

BACKGROUND OF THE INVENTION

Archers shooting bows have from the beginning used limbs which flex to store energy which is transferred to an arrow when released. This energy must be transferred to the arrow in the short distance that the string moves from full draw to the start position. The early "long bow" arrow velocity was low because it could not store much energy and could not transfer it efficiently to the arrow. The more modern "recurved bow" improved on the long bow, but the instability of the limb recurve limited the amount of energy stored and the ability to put that energy back into the arrow. The recurved bow attempted to correct this but was limited by the instability of the amount of recurve. The more recurve, the greater the instability. The Turkish and Persian bows achieved outstanding results but were delicate to build and difficult to handle.

Compound bows involve complex rigging of the bowstring over pulleys carried by the bow limbs. This rigging makes it virtually impossible to unstring the bow when it is not in use. Thus, the limbs of compound bows are always under significant stress, which eventually leads to a degradation of the limb fibers and a reduction in the bow weight with time for a given setting of the bow. This requires periodic retuning of compound bows to maintain the desired performance level. Typical examples of compound bows are shown in U.S. Pat. Nos. 4,112,909, 4,340,025, 4,350,138 and 4,183,345.

SUMMARY OF THE PRESENT INVENTION

In accordance with the present invention the sequential bow has been designed to provide smoothness both during the draw and release of the string. This is achieved by sequencing the action of the limbs by providing a recurved limb having different zones which react sequentially both in the draw and release of the string. A semi-flexible or rigid support is anchored in the riser to provide support for the limbs in the initial movement of the limbs when the string starts its movement.

When the string is at the brace height position its tension is very high since the pulling force is applied at a very small distance to the moment arm of the force in the string. As the string is drawn away from the bow handriser the moment arm increases and the semi-flexible support member flexes a little. The engagement of the end of the support member with respect to the more rigid section of the limb provides an anti-twisting feature. At full draw the limb's end section is uncovered and flexes, storing energy as well as further increasing the moment arm of the string to the limb's flexing zone and semi-flexing support member providing a drop in the pulling force.

One of the primary advantages of the present invention is the limb's geometry and flexibility which provides a more rigid zone in the center of the limb and flexible zones at each end of the limb. With this arrangement the string acts in successive sequence with different moments to the flexing limb's zones. With this arrangement the string brings to the arrow a progressive acceleration with a final snap from the two recurves just before the arrow leaves the string. A further advantage is provided by the bow wherein the force to pull the string reaches its maximum near the start of the draw with the force letting down as it comes to full draw, which provides a very smooth and easy feel to the archer. A further advantage is the drop in force at full draw. It is desirable for the archer to aim without the pressure of holding the string at full draw with the maximum force.

A further advantage is provided at the final pulling of the string by the limb's movements which are greatly enhanced and accelerated by the combined moment of inertia of the recurve zone snapping the string strongly to impart to the arrow the final accelerating force at the critical position.

Another aspect of the bow is the ability to use light plastic material at the free end of the limbs since the end zones do not necessarily have to flex.

The bow according to the present invention is similar to a compound bow in its action but is significantly different and superior to a compound bow because the bow achieves the same characteristics through the limb's new geometry of multiple zones of rigidity and flexibility and the sequential use of the limb uncovering successively different zones with different flexing characteristics.

Other principal features and advantages of the invention will become apparent to those skilled in the art upon review of the following drawings, the detailed description and the appended claims.

Figure 2:
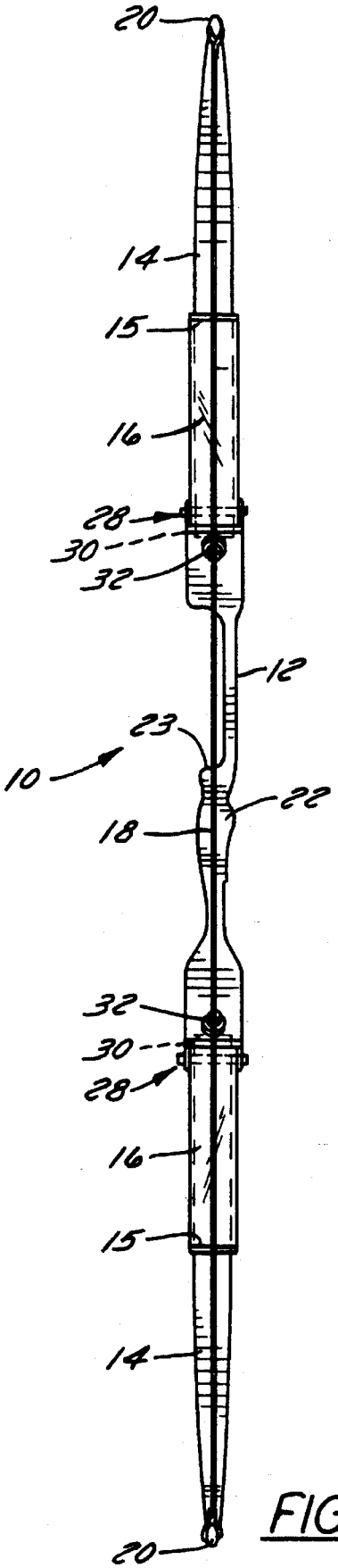
FIG. 2 is a front elevation view of the bow.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Figure 1:
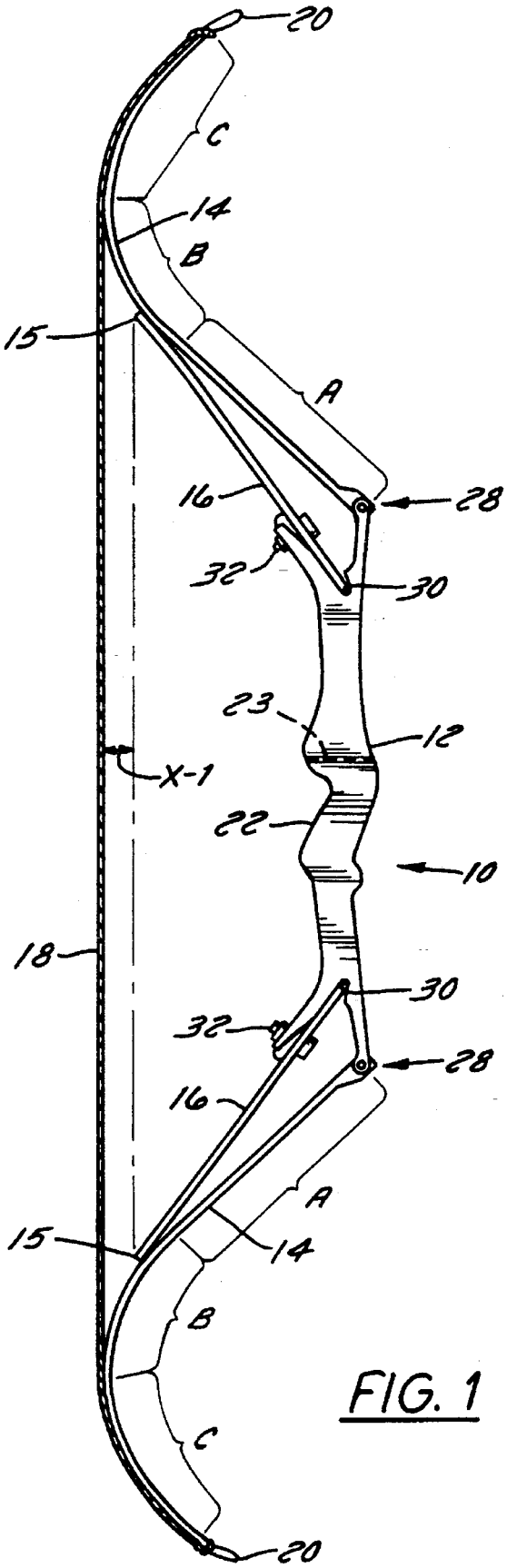
FIG. 1 is a side elevation view of the bow.

Referring to FIGS. 1 and 2 the bow 10 according to the present invention, generally includes a hand held riser 12, a pair of curved limbs 14 and a pair of support members 16. A string 18 is connected to the free end 20 of each of the limbs 14. As is generally understood the bow is held by grasping the handle portion 22 of the riser 12, seating an arrow 24 on the string 18 with the arrow aligned with an arrow rest 23 placed up from the window shelf on the riser 12. The arrow 24 is then drawn back to the position shown in FIG. 4 and released when aligned with the target. More particularly the riser 12 includes a handle section 22 intermediate the ends thereof. A pivot assembly 28 is provided at each end of the riser for pivotable connection to one end of each of the limbs 14. Intermediate supports 29 are angularly offset from the back of the ends of the riser 12. A pair of grooves 30 are provided on the back side of the riser 12 in a spaced relation to the handle. The support members 16 are seated in the grooves 30 as more particularly described herein. The support members 16 are retained in the grooves 30 by adjustment screws 32 mounted on the ends of the intermediate supports 29.

The limbs 14 may be formed of a number of materials such as solid glass fiber, carbon fiber lamination with foam or wood spacing lamination, glass fiber lamination with foam or wood spacing lamination and laminated layers of wood, such as maple, with fiberglass laminated on both sides of each of said layers. Other materials such as plastic or metal could also be used.

Figure 4:
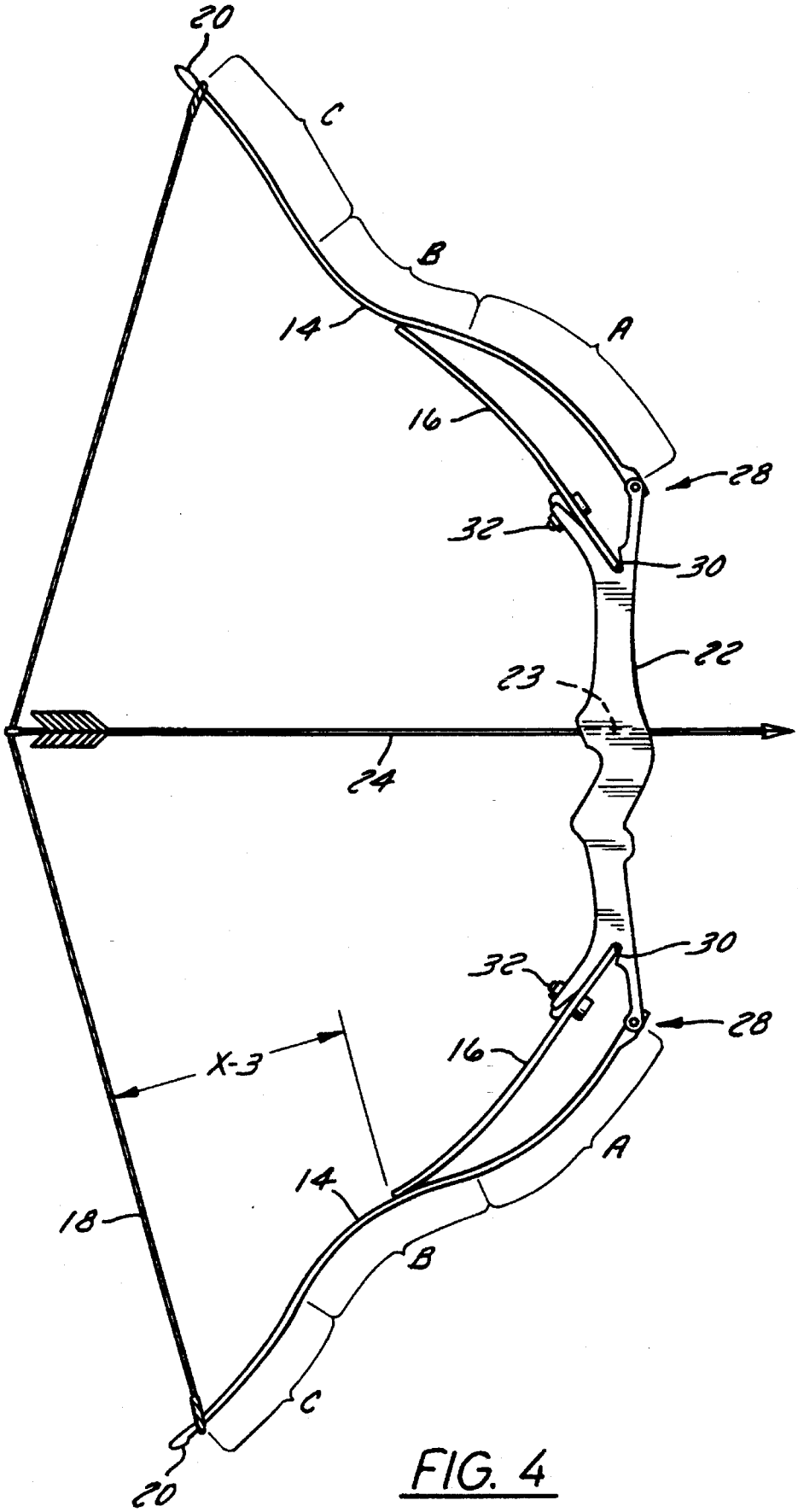
FIG. 4 is a side elevation view showing the bow in the full draw position.

Each of the limbs includes three sections or zones A, B and C. The sections or zones may have identical flexing characteristics or different flexing zones. Zone A may be flexing with the other zones B and C, semi-rigid to rigid, or A and C, flexing with B rigid. A typical laminated limb can be formed with two layers in the inner Section A, four layers in the middle Section B and three layers in the outer Section C. The Section A is connected to each end of the riser by the pivot assembly 28 which allows Section A to articulate to a curved position as shown in FIG. 4. As the string 18 is pulled away from the riser 12, the second Section B which is fairly rigid bears against the outer end 15 of the support members 16 to introduce a bend in the support member 16 when the string is initially pulled back. As the string 18 is pulled further the Section C will bend to form a curve at the end of the bow. It should be noted that the string is tangent to the surface of the limb at approximately the intersection of the Section B with the Section C.

The outer end of the support members 16 engage the Section B of the limb at a point spaced from the intersection of Section B with Section A. The support members 16 are fairly stiff and will bend slightly depending on the adjustment of the screws 32. The end of the support member 16 which engages the limb provides an anti-twist force to the center section of the limb.

Figure 3:
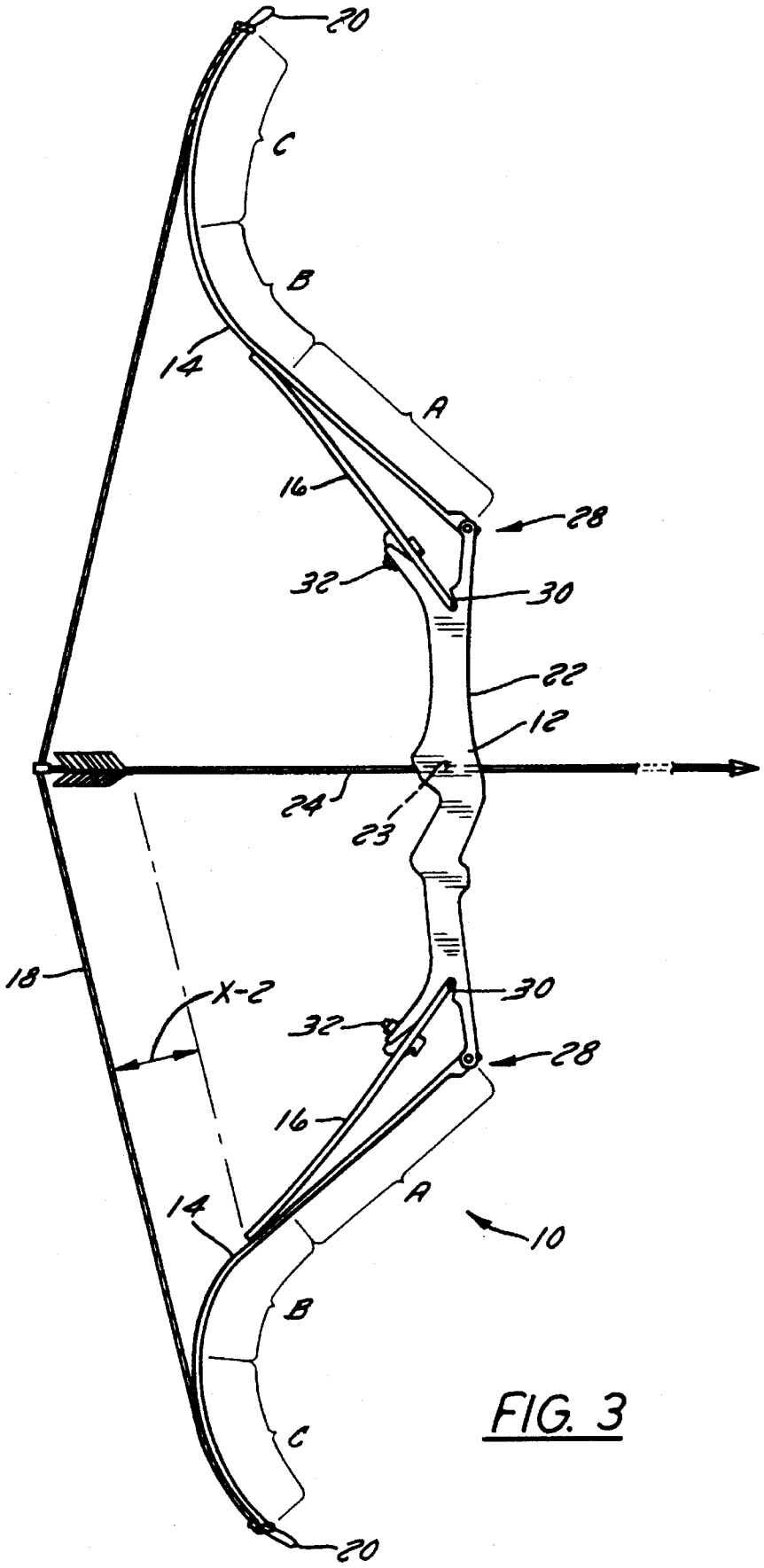
FIG. 3 is a side elevation view of the bow in the intermediate draw position.

In operation the archer pulls the string 18 away from the riser, forcing the limbs into engagement with the ends of the support members 16, forcing the members 16 to bend inwardly as shown in FIG. 3. As the string 18 is pulled farther back the Section A flexes introducing a rotation in the Section B. At full draw the string will pull Sections B backward uncovering Section C and introducing a recurve in Section C.

During the draw the following steps occur in sequence. At the start the string 18 is located a distance X-1 from a line 17 drawn through the ends 15 of the support member 16. As the string 18 is pulled backward by the archer the distance X-2 of the string 18 from the line 17 drawn parallel from the end 15 of the support member 16 increases. The rigid Section B of the limb will bear against the ends of the support members 16 bending the support members rearwardly through the intermediary of the rigid limb Section B. The pull is very heavy since the support member 16 is fairly stiff. It should also be noted that the distance X-2 of the string to the end of the support members 16 is very small thus requiring a strong pulling force.

As the string 18 is pulled further away from the riser it acts on more of the limb, and starts to flex the Sections A of the limb as shown in FIG. 3, uncovering Section C and starting to load the recurve in Section A. The distance X-2 of the string 18 to the point of engagement with the end of the support member 16 increases drastically as the Section C is uncovered by the pivotal movement of the Section C. The direction of the force has also changed and the force necessary to draw the string has reached its peak before starting to level off.

At the final pull of the string the Section C is fully uncovered and is fully flexed. The string acts at a greater distance X-3 from the end of the support members 16 and is acting directly on the end of the Section C. All three sections of the limb, A, B and C are now under full tension. The support member 16 is also under full tension. This results in the full uncovering of the Section C as shown in FIG. 4. The force applied by the string 18 at the end of Section C to the rotating moment center decreases because the distance of the force has increased enormously.

Figure 5:
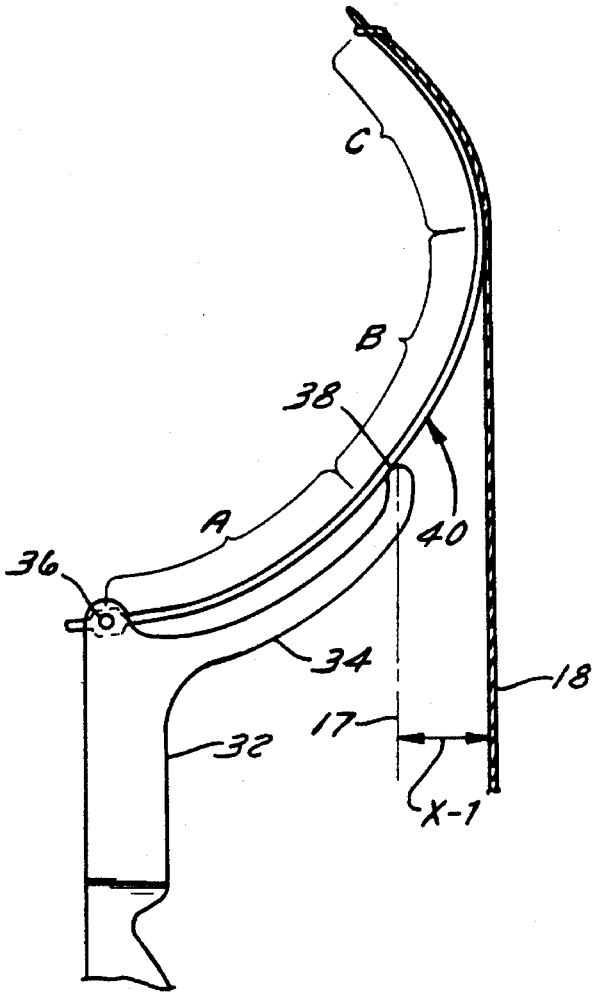
FIG. 5 is a side elevation view of a bow having a fixed support member with the limbs pivotally connected to the riser.
Figure 6:
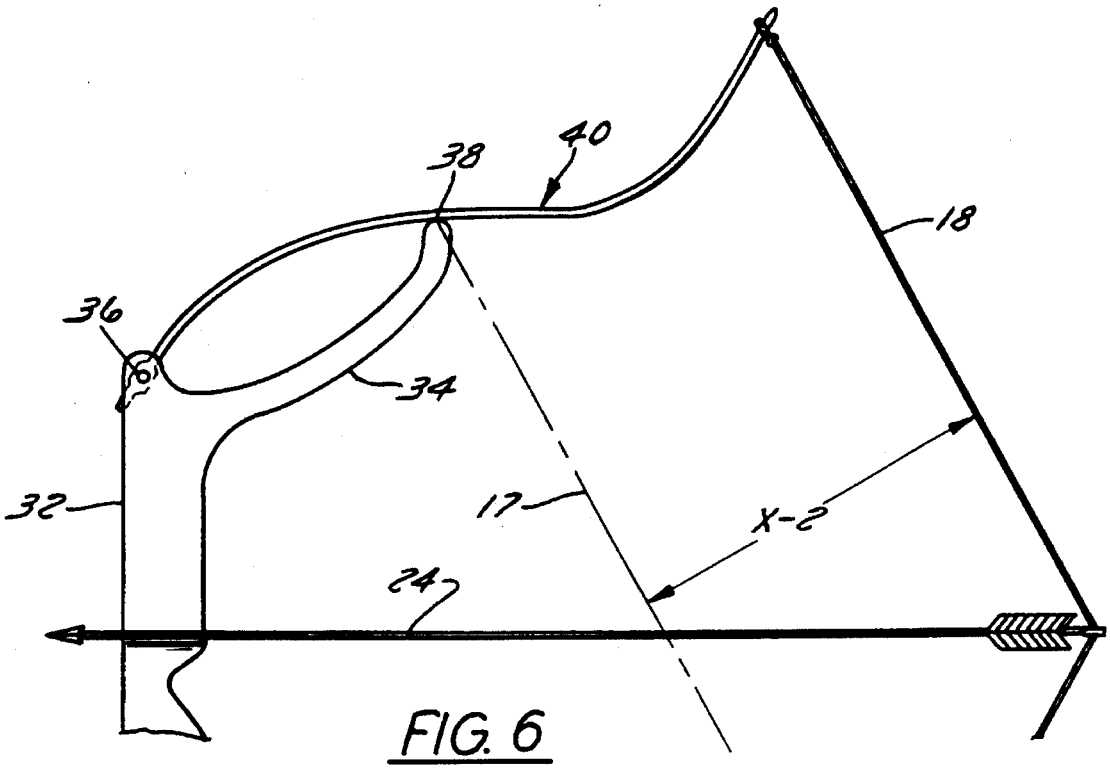
FIG. 6 is a view similar to FIG. 5 showing the limb in the drawn position.
Figure 7:
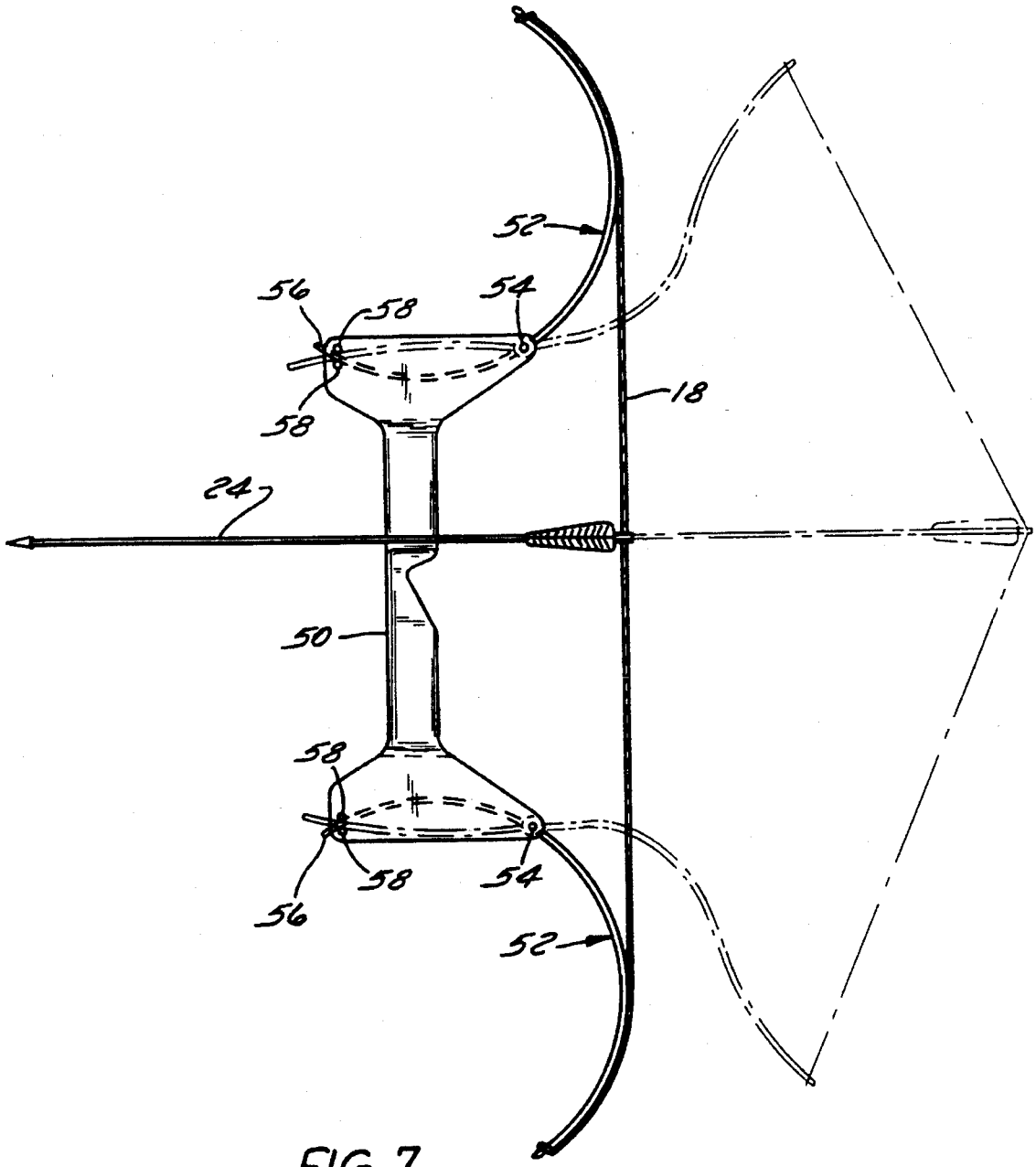
FIG. 7 is a side elevation view of the bow having a support member mounted on each end of the riser with the limbs pivotally connected to the support member between the inner and middle sections of the limb.
Figure 8A:
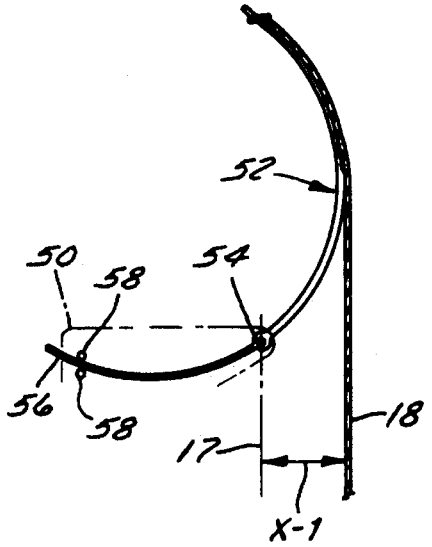
FIG. 8A is a schematic view of one of the limbs of FIG. 7 showing the limb in the rest position.
Figure 8B:
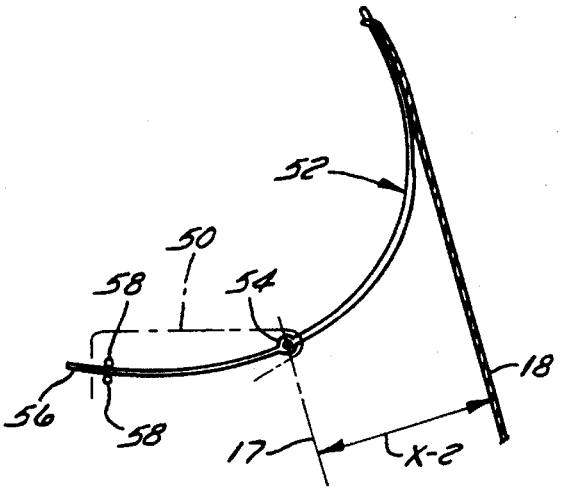
FIG. 8B is a view similar to FIG. 8A showing the difference of the moment arm X-2 of the limb as it is drawn away from the riser.
Figure 8C:
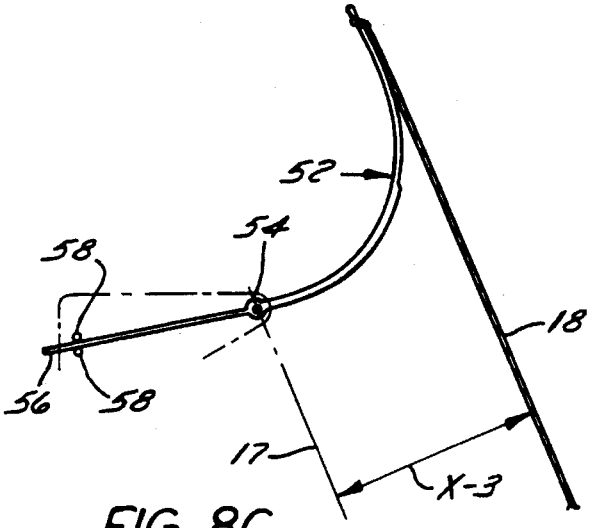
FIG. 8C is a view similar to FIG. 8A showing the increase in the moment arm in an intermediate position.
Figure 8D:
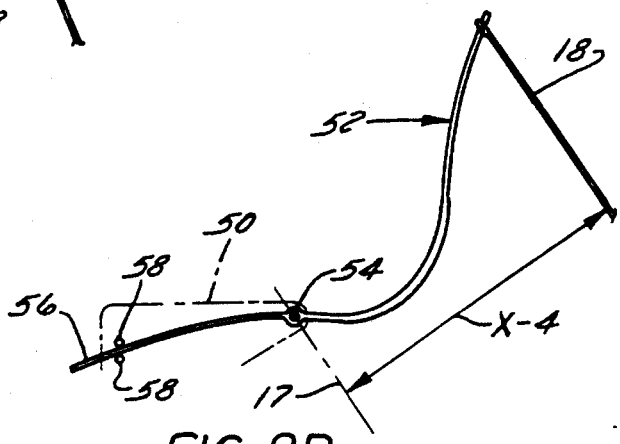
FIG. 8D is a view of the limb shown in the full pull position showing the increasing length of the moment arm.

Referring to FIGS. 5 and 6 a portion of an alternate form of riser 32 is shown having a fixed support member 34 and a rotatable pivot 36 at each end of the riser. A three section limb 40 is connected to the pivot 36 at one end and bears against the end 38 of the support member 34. With this arrangement the limbs 40 will move with respect to the ends 38 of the support members 34 as the arrow is drawn back to the position shown in FIG. 6. The distance X-1 of the string 18 from the line 17 increases to a distance X-2 as noted above. On release of the arrow the limbs 40 will return to their initial positions with each section of the limb operating in sequence. It should be noted that the end of the limb pivots at 36, while the section B is free to move with respect to the end 38 of the fixed support member 34. The two support members keep the nocking point centered during the draw and release of the string.

Referring to FIGS. 7 and 8A–8D another form of riser 50 is shown wherein the limbs 52 are pivotally connected to the end of the support arms 54. The inner ends 56 of the limbs 52 are free to move with respect to the pins 58 provided on the riser. In this embodiment the center section B is rigid. It should be noted in FIGS. 8A, 8B, 8C and 8D that as the bowstring 18 is pulled rearwardly the moment arm X-1 will gradually increase from the pivot point 54 on the support arm as noted in FIGS. 8B, X-2; and FIG. 8C, X-3; to a maximum position shown in FIG. 8D, X-4. On release of the arrow the limbs 52 will return to their original position in sequence.

Thus, it should be apparent that there has been provided in accordance with the present invention a sequential bow that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A sequential bow comprising a rigid, elongate handle riser having opposite ends and intermediate support members angularly offset from said ends, an elongate recurved resilient limb pivotally mounted on each end of said riser, the limbs including three sections of different degrees of flexibility, the middle section of each limb having the least flexibility, said support members being positioned to engage the the middle section of said limbs and a bowstring connected to the outer ends of said limbs, said bowstring being adapted to be drawn from a rest position to a drawn position on application of a drawing force thereto.

2. The bow according to claim 1 including means mounted on said riser for varying the angle of flexibility of the support member.

3. The bow according to claim 1 wherein the force introduced into the limbs on drawing the bowstring back is given back in sequence to the arrow upon release of the bowstring.

4. The bow according to claim 1 wherein one end of each inner section is pivotally connected to the riser.

5. The combination of a sequential bow and an arrow comprising:

a handle riser, a pair of intermediate supports angularly offset from the back of the riser, a resilient limb having one end pivotally mounted on each end of the riser, each limb having three sections, the middle section having the least flexibility, a support member mounted on each of said intermediate supports in a position to engage the middle section of each of said limbs intermediate the ends thereof, a bowstring operatively connected to the ends of said limbs, said limbs being drawn into engagement with said elongate member by said bowstring, and said arrow being mounted on said riser with one end aligned with said bowstring whereby the forces introduced into said limbs on drawing the arrow back from the riser are released in sequence.

6. The bow according to claim 5 wherein each of said sections has a different degree of flexibility whereby on release of the bowstring the forces will be released in sequence.

7. The combination of an arrow and a sequentially actuated bow for releasing the arrow, said bow comprising a riser, a limb pivotally mounted on each end of said riser, each of said limbs including an inner section, an intermediate section and an outer section, said intermediate section having the least degree of flexibility, a support member on each end of said riser positioned to engage said intermediate section of said limb, a bowstring connected to the ends of said limbs with the arrow supported on said riser with one end of the arrow aligned with the bowstring whereby the forces introduced into the limbs when the arrow is drawn away from the riser are released in sequence when the arrow is released.

8. A sequential bow comprising:

a hand held riser, a limb mounted on each end of said riser, each limb including an inner section, an intermediate section and an outer section, each of said sections of each limb has a different degree of flexibility, the inner section of each limb is pivotally connected to said riser, the intermediate section having the least flexibility, a support member mounted on each end of said riser in a position to engage the intermediate section of each of the limbs, and a bowstring attached to the ends of each of said limbs whereby a recurve is introduced into the inner section when the limbs are drawn rearwardly of said support member and the outer sections of each of said limbs will be drawn together rearwardly of said support members.

* * * * *